US005868386A

United States Patent [19]

Stiel et al.

[11] Patent Number: 5,868,386

[45] Date of Patent: Feb. 9, 1999

[54] BLOWER CHAMBER FOR THE FLOATING CONVEYANCE OF SHEETS OR WEBS

[75] Inventors: Jürgen Alfred Stiel, Thüngen; Volkmar Rolf Schwitzky, Würzburg, both of Germany

[73] Assignee: Koenig & Bauer Aktiengesellschaft, Wurzburg, Germany

[21] Appl. No.: 700,361

[22] PCT Filed: Mar. 1, 1995

[86] PCT No.: PCT/DE95/00259

§ 371 Date: Sep. 3, 1996

§ 102(e) Date: Sep. 3, 1996

[87] PCT Pub. No.: WO95/23754

PCT Pub. Date: Sep. 8, 1995

[30] Foreign Application Priority Data

Mar. 3, 1994 [DE] Germany ..... 44 06 848.4

[51] Int. Cl.[6] ..... B65H 29/24

[52] U.S. Cl. ..... 271/195

[58] Field of Search ..... 271/195, 194, 271/211, 97; 226/95

[56] References Cited

U.S. PATENT DOCUMENTS

| | | |
|---|---|---|
| 3,633,281 | 1/1972 | Vits . |
| 3,957,187 | 5/1976 | Puigrodon . |
| 4,218,001 | 8/1980 | Vits . |
| 4,432,221 | 2/1984 | Barton . |
| 4,632,321 | 12/1986 | Danler . |
| 5,102,118 | 4/1992 | Vits . |

FOREIGN PATENT DOCUMENTS

| | | | |
|---|---|---|---|
| 2 490 973 | 4/1982 | France . | |
| 1 907 083 | 9/1970 | Germany . | |
| 28 02 610 | 5/1983 | Germany . | |
| 89 15 626 | 4/1991 | Germany . | |
| 2255079 | 10/1992 | United Kingdom | 271/195 |

*Primary Examiner*—David H. Bollinger
*Attorney, Agent, or Firm*—Jones, Tullar & Cooper, P.C.

[57] ABSTRACT

A blowing chamber is used for the suspended guidance of sheets or webs. The blowing chamber includes a guidance surface which is provided with a plurality of nozzles. Each of these nozzles has a generally rectangular blower opening which directs air up along an inclined guide surface that terminates at the sheet guidance surface in an arc-shaped transition.

5 Claims, 3 Drawing Sheets

BLOWER CHAMBER FOR THE FLOATING CONVEYANCE OF SHEETS OR WEBS

FIELD OF THE INVENTION

The present invention relates to a blowing chamber for the suspended guidance of sheets or webs in processing machines, in particular rotary printing presses.

DESCRIPTION OF THE PRIOR ART

DE-PS 19 07 083 describes a blowing chamber with several blower openings disposed in a distributed manner, which openings respectively have an oblique guide surface extending downward into the blowing chamber. However, in this case, the nozzles have a tongue and the radial guide surfaces enclose an angle between 120° and 180°. By means of this, a widely fanned out jet with a flat effect is generated, not a directed jet. Also, all blowing nozzles are disposed in the same direction. By means of this, it is possible to exert a barely tightening force in only one direction, which is particularly disadvantageous with thin sheets, because they easily tend to flutter because of this.

DE-PS 28 02 610 discloses nozzles, the lateral surfaces of whose oblique guide surfaces extend parallel and are provided with a lowered tongue. These nozzles are disposed closely together next to each other on blowing chambers. A guide path is described, which consists of several blowing chambers which are disposed above and below of sheets to be guided. No closed guide surface results from this. The air flows off through gaps created between the individual blowing chambers, so that no even air cushion is created and the sheets are guided along the guide path in a wave shape. It is disadvantageous in connection with the described nozzles that the emerging air jets do no diverge, so that a large number of nozzles are required for building a homogeneous air cushion.

A blowing chamber in accordance with the species for the suspended guidance of sheets or webs in processing machines is known from DE 89 15 626 U1. Here, the nozzle bodies of the blowing chamber have a nozzle opening, which is followed by a guidance surface. Blowing jets emerging from the nozzle opening are guided along this guidance surface.

It is disadvantageous here that only blowing jets with undefined opening angles of more than 100° are created.

SUMMARY OF THE INVENTION

It is the object of the present invention to create a blowing chamber for the suspended guidance of sheets or webs which has a guidance surface provided with nozzles but otherwise closed off, by means of which an evenly supporting air cushion, i.e. without gaps or oppositely acting blowing jets, can be provided between the blowing chamber and the sheets or webs, and whose nozzles generate a directed, laterally bounded blowing jet.

This object is attained in accordance with the invention by means of a device that forms a blowing chamber for the suspended guidance of sheets or webs in a processing machine, such as a rotary printing press. The blowing chamber has a guidance surface which has nozzles but which is otherwise closed. This surface, and its nozzles, face the sheets or webs. The nozzles have blower openings and adjoining guide surfaces which extend obliquely into the interior of the blowing chamber. These guide surfaces end in a circular arc-shaped transition at the guidance surface. The blower openings are rectangular in configuration and the guide surfaces define an opening angle between the blower openings and the arc-shaped transition of between 20° and 50°.

It is achieved by means of a blowing chamber in accordance with the invention and the arrangement of the nozzles that a particularly even air cushion is formed over an entire guidance surface. By means of this air cushion, a sheet or a web is simultaneously supported and aspirated because of the effect of the aerodynamic paradox. In spite of this even air cushion, in which the suction and pressure forces are in an equilibrium, directed, slightly diverging flows of the nozzles exert forces for tightening in defined directions. In an advantageous manner these forces are directed to free edges of the sheet.

A division of the guidance surface into three zones across its width, central stabilization zone, and right and left tightening zones has been shown to be particularly advantageous.

An even air cushion is generated in this area of the guidance surface by means of the stabilization zone located symmetrically with an axis of symmetry, which simultaneously exerts a tightening effect on the sheet opposite the conveying direction F and acts counter to the injector effect generated in the tightening zones i.e. air is removed from the stabilization zone.

Tightening zones adjoin both sides of the stabilization zone, in which the nozzles, pointing away in a conveying direction F from the axis of symmetry, enclose an angle between 120° to 180° or −120° to −180°. A tightening effect in the direction of the trailing edges of the sheets is generated in the tightening zones, and at the same time air is removed from the stabilization zone as well as from the tightening zone. In this way, the height of the air cushion cannot increase viewed in the conveying direction F.

In an arrangement that is particularly suited for thin unstable sheets which have a strong tendency to flutter, the nozzles are directed in such a way that each blowing jet is disrupted by a second air jet blowing at approximately right angles to the first so that no wave generation is caused by a continued jet, i.e. the blowing jet of each nozzle extends in a straight line only over a short distance. By means of two prevailing blowing directions, which are directed essentially perpendicularly in respect to each other, fluttering, i.e. wave generation moving in the blowing direction, is suppressed.

In this case, the resultants of the blowing direction of the nozzles nevertheless exhibit edges in the trailing direction for achieving the desired tightening effect.

BRIEF DESCRIPTION OF THE DRAWINGS

The blowing chamber in accordance with the present invention is represented in the drawings and will be described in more detail below, in which.

DESCRIPTION OF THE PREFERRED EMBODIMENTS

Figure 1:
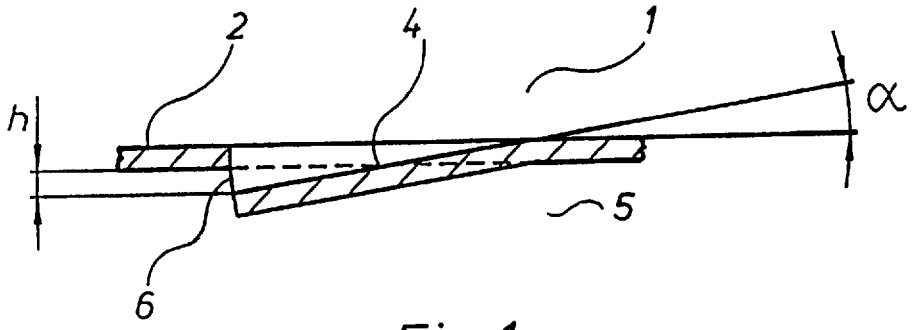
FIG. 1 is a section through the device in accordance with the present invention in the area of a nozzle in the longitudinal direction.
Figure 2:
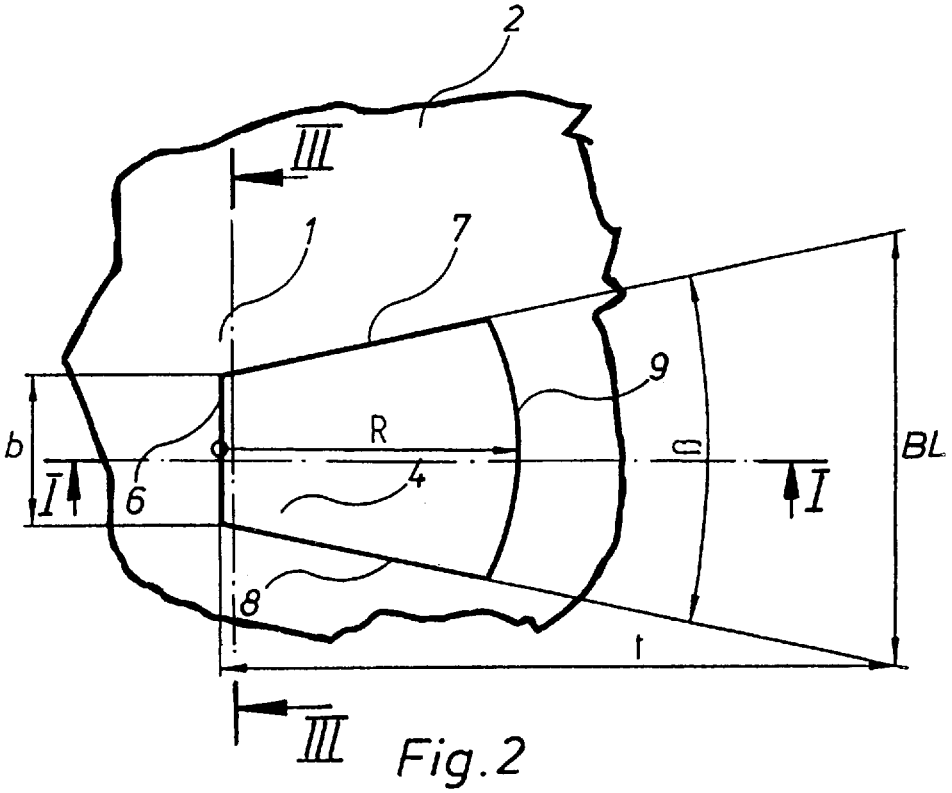
FIG. 2 is a top view of the portion represented in FIG. 1.
Figure 3:
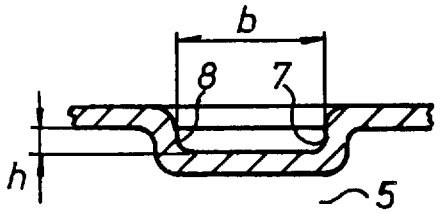
FIG. 3 is a section through the device in accordance with the invention in the area of a nozzle in the transverse direction.

A nozzle 1 employed in the device in accordance with the invention will be described in more detail by means of FIGS. 1 to 3:

The nozzle 1 has been placed in a closed guidance surface 2 of the blowing chamber 5 extending along a conveying path of a sheet 3. For example, a straight cut of the width b is made by means of a deep drawing tool in the surface 2, and at the same time a nozzle guide surface 4 which extends downward at an angle alpha of 2° to 6° into the blowing chamber 5 is formed.

The nozzle 1 produced in this manner has a blower opening 6 with a cross-sectional air outlet surface A resulting from the height h and the width b. The width b and the height h are at a ratio of b/h=5 to 10, and the width b can be 5 to 20 mm. The flow of a gaseous medium, for example air, is guided along the nozzle guide surface 4, starting at the blower opening 6. This nozzle guide surface 4 is bounded by the blower opening 6, by two edges 7 and 8, which are diverging at an opening angle beta of 20° to 50° in relation to the longitudinal center line of the section 6; and by a circular arc-shaped transition 9 with the radius R (R/b—1 to 3), located opposite the blower opening 6 from the guide surface 4 to the guidance surface 2. The diverging edges 7 and 8 form closed lateral surfaces between the guidance surface 2 and the nozzle guide surface 4 extending downward in respect to the guidance surface 2. By means of this, a flat jet nozzle results as the nozzle 1, with a directed, slightly divergent jet. This nozzle 1 is charged with a pressure of 100 to 500 PA. In the instant case, air, or air enriched with a solvent or water, is used as the gaseous medium.

Figure 4:
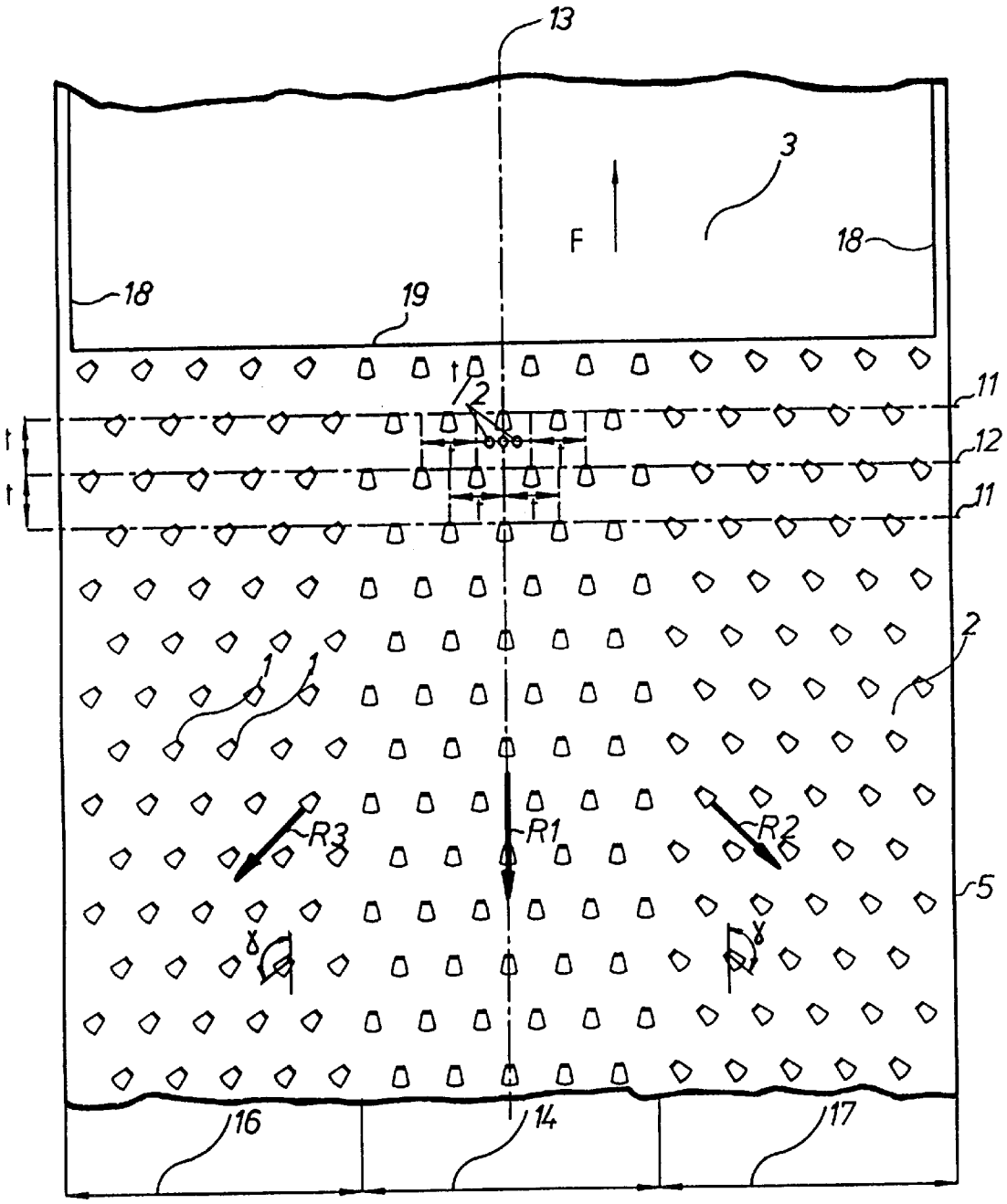
FIG. 4 is a top view over the entire width of the device in accordance with the present invention in a first preferred embodiment.

A first preferred embodiment, in the form of a plurality of the above described nozzles 1 in an arrangement over the width and length of the guidance surface 2, is represented in FIG. 4. In respect to an axis of symmetry 13 extending in the conveying direction F, the nozzles 1 are symmetrically disposed in transverse rows and have a division t or spacing in each transverse row. Each two successive transverse rows of nozzles 11 and 12, extending over the width of the guidance surface 2, are offset from each other by half a division t in respect to an axis of symmetry 13 extending along the conveying direction F. The division t results as a function of the opening angle beta which determines a width BL of the air jet at the distance of the division t from the blower opening. The ratio of the division t to a width BL of the air jet preferably is approximately t/BL 1 to 2. The total surface of the blower openings 6 is 0.1% to 1% of the surface of the guidance surface 2.

By means of the arrangement of the nozzles 1 over its width, the guidance surface 2 is divided into three zones 14, 16, and 17. A central stabilization zone 14 is symmetrically located on both sides of the longitudinal axis of symmetry 13. One tightening zone 16 or 17 of the tightening zones 16 and 17 adjoins the central stabilization zone 14.

The nozzles 1 in the stabilization zone 14 are oriented facing opposite the sheet conveying direction F, while in the two tightening zones 16 and 17 the longitudinal center of the nozzles 1, together with the conveying direction F, enclose an angle gamma of 120° to 150°, which in the first example is 135°, and which is oriented away from the axis of symmetry 13. Here the direction of blowing is approximately oriented toward the trailing edges 18 and 19 of the sheet 3.

Thus, ensuing resultants R1, R2, R3 of the blowing direction of the nozzles 1 point opposite to the conveying direction F in the stabilization zone 14, and in the two tightening zones 16 and 17 point approximately toward the trailing edges 18, 19 of the sheet 3.

Figure 5:
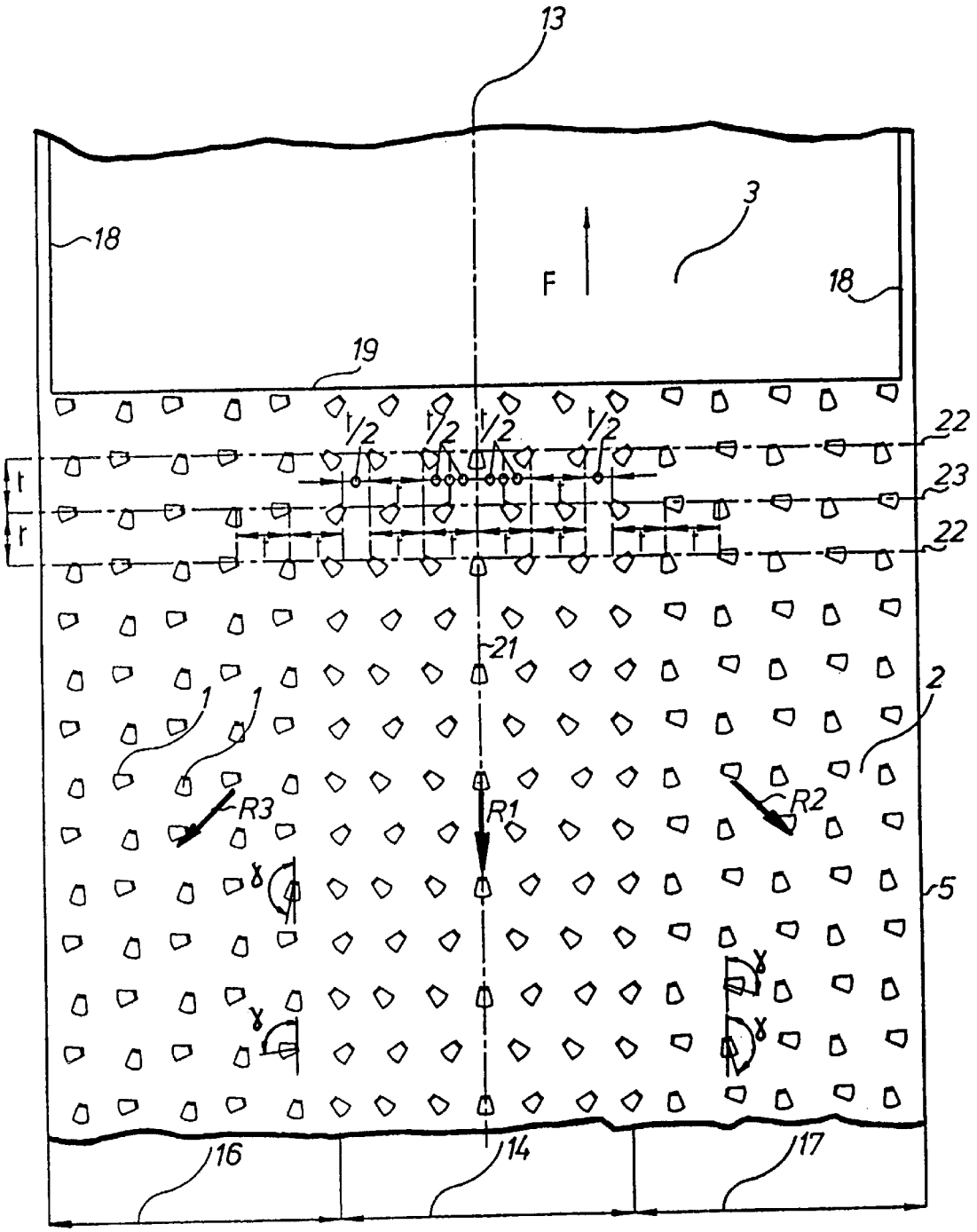
FIG. 5 is a top view corresponding to FIG. 4 of a second preferred embodiment.

In the second preferred embodiment of the present invention, as in represented in FIG. 5, the stabilization zone 14 and tightening zones 16 and 17 are also provided. However in this second embodiment the nozzle rows 22 and 23 in the two tightening zones 16 and 17 are not offset by one half division t with respect to each other.

The stabilization zone 14 is here constituted by a single longitudinal nozzle row 21 extending on the axis of symmetry 13, and at whose sides the adjacent nozzles in each of the successive travsverse nozzle rows 22, 23 have been inserted which alternately blow towards and away in respect to the axis of symmetry 13 at an angle of 450°, but opposite to the conveying direction F. In the tightening zones 16 and 17, the longitudinal axes of the nozzles 1, together with the conveying direction F, enclose an angle gamma changing from 100° to 120° or 160° to 170° pointing away from the axis of symmetry 13.

It is common to both nozzle arrangements depected in FIG. 4 and in FIG. 5, that the ratio of the division t to the width BL of the air jet as a function of the opening angle beta is t/BL=1 to 2. The resultant R1 of the blowing directions of the stabilization zone 14 extend parallel and opposite the conveying direction F, while in the tightening zones 16 and 17 the resultants R2, R3, together with the conveying direction F, enclose an angle of 135° pointed away from the axis of symmetry 14.

It is achieved by means of the nozzle arrangement in both embodiments that a succeeding nozzle 1 is associated with each preceding nozzle 1 and blows into the rear area of the preceding nozzle 1. No continuous straight flow can be created in the tightening zones 16 and 17 by the nozzle arrangement in accordance with FIG. 5, since each nozzle 1 is associated with a second nozzle 1 blowing approximately perpendicularly in respect to the first, which laterally deflects the blowing jet of the first nozzle 1.

In an advantageous manner, the width of the stabilization zone 14 is less than the smallest size of the sheets 3 to be guided, while the width of the closed guidance surface 2 should be greater than the largest size of the sheets to be guided.

In the instant example, the maximum width of the sheet 3 is approximately 1000 mm, the minimum width of the sheet 3 approximately 500 mm and the width of the guidance surface 2 approximately 1100 mm. The length of the guidance surface extends along the sheet conveyance path, for example between two printing units or between a printing unit and a delivery device of a rotary printing press.

While preferred embodiments of a blowing chamber for the suspended guidance of sheets or webs in a processing machine, such as a rotary printing machine, has been set forth fully and completely hereinabove, it will be apparent to one of skill in the art that a number of changes in, for example, the type of printing machine used, the source of the compressed air, the overall size of the chamber and the like could be made without departing from the true spirit and scope of the present invention which is accordingly to be limited only by the following claims.

We claim:

1. a blowing chamber for the suspended guidance of sheets and webs in a processing machine such as a rotary press comprising:

a guidance surface, said guidance surface facing sheets and webs to be guided, in a conveying direction;

a plurality of nozzles formed in said guidance surface which is otherwise closed, said nozzles facing sheets and webs to be guided, each of said nozzles directing at jet of gaseous medium of a jet width onto said guidance surface;

a blower opening in each of said nozzles, each said blower opening having a planar cross-sectioned air outlet surface with a width and a height;

a guide surface extending obliquely for each of said blower openings to said guidance surface and ending at said guidance surface in a circular arc-shaped transition; and radial edges defining said edges of said guide surface, said radial edges enclosing an opening angle of between 20° and 50°.

2. The blowing chamber of claim 1 wherein a ratio of said blower opening outlet surface width to said blower opening outlet surface height is 5 to 10.

3. The blowing chamber of claim 1 wherein said blower opening outlet surface width is 5 mm to 20 mm.

4. The blowing chamber device of claim 1 wherein said gaseous medium is supplied to said nozzles at a pressure of 100 Pa to 500 Pa.

5. A blowing chamber for the suspended guidance of sheets and webs in processing machines comprising:

a guidance surface facing sheets and webs to be guided;

a plurality of nozzles formed in said guidance surface which is otherwise closed, said nozzles facing sheets and webs to be guided;

a blower opening in each of said nozzles; and a guide surface extending obliquely from each of said blower openings to said guidance surface and ending at said guidance surface in a circular arc-shaped transition, a total area of said blower openings being 0.1% to 1.0% of a total area of said guidance surface.

* * * * *